US006915907B2

(12) United States Patent
Myers

(10) Patent No.: US 6,915,907 B2
(45) Date of Patent: Jul. 12, 2005

(54) PRODUCT DISTRIBUTION ASSEMBLY

(75) Inventor: Brian Myers, Indianapolis, IN (US)

(73) Assignee: Cabot Safety Intermediate Corporation, Newark, DE (US)

( * ) Notice: Subject to any disclaimer, the term of this patent is extended or adjusted under 35 U.S.C. 154(b) by 61 days.

(21) Appl. No.: 10/247,228

(22) Filed: Sep. 19, 2002

(65) Prior Publication Data

US 2004/0055923 A1 Mar. 25, 2004

(51) Int. Cl.[7] ..... B65D 25/54
(52) U.S. Cl. ..... 206/782; 206/733
(58) Field of Search ..... 206/731, 733, 206/734, 775, 776, 777, 782, 763, 769, 772, 773, 774; 221/303, 305, 306, 34, 45, 61; 229/120.37, 130.38, 122, 122.1, 162.1, 162.3, 162.6

(56) References Cited

U.S. PATENT DOCUMENTS 1,670,498 A * 5/1928 Einson ..... 206/782
3,058,619 A * 10/1962 Jaeschke ..... 221/305
3,066,843 A * 12/1962 Johnson ..... 229/17
3,309,206 A * 3/1967 Daniels ..... 426/115
3,459,329 A * 8/1969 Mochizuki et al. ..... 206/494
3,747,831 A * 7/1973 Hanson ..... 229/27
3,872,966 A * 3/1975 Gordon et al. ..... 206/459
4,186,866 A * 2/1980 Zicko ..... 229/221
4,767,022 A * 8/1988 Oldorf ..... 221/92
5,067,609 A * 11/1991 Stout ..... 206/782
5,280,845 A 1/1994 Leight
5,328,082 A * 7/1994 Fritz et al. ..... 229/122.1
5,370,220 A * 12/1994 Wang ..... 206/499
5,372,278 A 12/1994 Leight
5,570,808 A * 11/1996 Tassoni ..... 221/34
5,772,032 A 6/1998 Goldman
6,059,113 A * 5/2000 Hodges ..... 206/443
6,079,617 A 6/2000 Kim
6,135,288 A 10/2000 Kim
6,237,777 B1 * 5/2001 Bierly ..... 206/758
6,273,331 B1 8/2001 Kelley
6,402,021 B1 6/2002 Heathcock
6,435,403 B1 8/2002 Giblin et al.

* cited by examiner

*Primary Examiner*—Shian T. Luong
(74) *Attorney, Agent, or Firm*—Cantor Colburn LLP

(57) ABSTRACT

An earplug distribution assembly is provided including an outer portion including four outer side panels, a top panel, and a bottom panel connected to form a box, an inner portion received at an interior of the box, the inner portion delimiting a plurality of chambers in the box, and earplugs stored in the chambers, one of the outer side panels including openings corresponding to each of the plurality of chambers thus allowing a user to access the earplugs in the chambers, each chamber including a distinct type of the earplugs.

14 Claims, 4 Drawing Sheets

PRODUCT DISTRIBUTION ASSEMBLY

BACKGROUND

1. Field of the Invention

The present invention relates generally to product distribution, and more particularly to an earplug distribution assembly for distributing a variety of types of earplugs.

2. Description of Related Art

Disposable earplugs are used in large quantities in manufacturing and industrial operations. Many types of earplugs are known, including foam roll-down-type earplugs, push-in stemmed earplugs, corded earplugs, metal detectable earplugs, etc. On-site conditions at manufacturing and industrial facilities may necessitate the use, and hence the distribution, of a variety of earplug types. For example, one area of a manufacturing facility may have heightened noise levels with respect to another area of the facility. Workers in the higher noise area will require earplugs with a higher attenuation then workers in a lower noise area. Further, individual workers in a manufacturing or industrial facility may simply prefer to use different types of earplugs. For example, one worker may prefer the comfort of one type of earplug while another worker desires insertion capabilities provided by another type of earplug. Additionally, state, local, and federal occupational safety requirements may require the presence, distribution and use of a plurality of earplug types at a single facility.

Traditional methods of earplug distribution include providing a large open box of individual earplugs for workers to access as needed. Often, however, workers will inadvertently acquire more earplugs than are necessary when accessing the box by hand. Extra earplugs are commonly discarded about the work space, wasting the earplugs and requiring subsequent clean-up efforts. Additionally, sanitization of the earplugs is jeopardized in such a free-for-all distribution. Further, if a variety of earplug types are desired or otherwise required at a given point of distribution, either all earplug types are placed in the single large open box, thus obviously complicating distribution, or several large open boxes are provided, one for each earplug type. This latter method of distributing the variety of earplug types does not cure the above-mentioned deficiencies of open box distribution and necessarily requires a plurality of the large open boxes, thus consuming valuable manufacturing and operational space.

Open box distribution is utilized with respect to individual earplugs, as mentioned, as well earplug pairs packaged together in small plastic or paper packages. As described above with reference to individual earplugs, these earplug pair packages are placed in large open boxes near a point of distribution at a manufacturing or industrial site. Workers may then access the packaged plugs by hand ensuring that only two plugs are attained at any one time, thus reducing waste associated with open box distribution of individual earplugs where workers often retrieve more earplugs then are necessary. Also, open box distribution of packaged earplug pairs maintains the sanitization of the wrapped earplugs even if handled or dropped on the floor and then returned to the large open box.

However, where a facility desires or is otherwise required to provide a plurality of earplug types, the large open box method of distributing packaged earplug pairs still incurs the deficiencies described above with respect to large open box distribution of single earplugs, e.g., several large boxes are required, floor space is consumed, etc.

Another known method of distributing earplugs utilizes a wall mounted earplug dispenser. Such dispensers are typically made of plastic and include a mount assembly to which an earplug container is affixed. Individual earplugs are stored in the earplug container. A dispensing means, such as a rotatable impeller assembly, is located within the earplug container and facilitates the dispensing of the earplugs from the container through an opening to the hand of a user. The impeller assembly is rotated, manually by the user or automatically by some mechanical means, and guides one or several of the individual earplugs toward the opening in the container. When the earplug(s) reach the opening, they fall from the container to the waiting hand of the user.

A wall-mounted earplug dispenser, like that described, does not provide for easy distribution of a variety of earplug types. One such dispenser may be loaded with several types of earplugs, however, in this case, the dispenser would not allow consistent distribution of the different earplug types, i.e., successively operating the dispenser would result in discharge of random earplugs thus complicating a user access to a particular type of plug. Alternatively, to distribute a variety of earplug types, a wall-mounted earplug dispenser may provided on-site for each plug type. This method, however, is expensive and laborious considering that individual wall-mounted dispensers can be costly and manually re-stocking empty dispensers is often difficult and time consuming. Additionally, wall-mounted dispensers often operate in a faulty manner, discharging inconsistent numbers of earplugs or jamming during use, and thus may be undesirable for industry use.

Accordingly, an earplug dispenser is desired which is easy to manufacture and assemble and which is capable of conveniently distributing a plurality of earplug types in an efficient, effective, and consistent manner.

SUMMARY OF THE INVENTION

According to the present invention, an earplug distribution assembly is provided. The earplug distribution assembly generally includes an outer portion including four outer side panels, a top panel, and a bottom panel connected to form a box, an inner portion received at an interior of the box, the inner portion delimiting a plurality of chambers in the box, and earplugs stored in the chambers, one of the outer side panels including openings corresponding to each of the plurality of chambers thus allowing a user to access the earplugs in the chambers, each chamber including a distinct type of the earplugs.

A corrugated paper board product distribution assembly blank is also provided herein. The corrugated paper board product distribution assembly generally includes an outer portion including a first side panel, a second side panel, a front panel, and a rear panel, the first side panel being pivotally connected to the front panel, the front panel being pivotally connected to the second side panel, and the second side panel being pivotally connected to the rear panel; a first side top flap, a second side top flap, and a rear top flap, the first side top flap pivotally connected to the first side panel, the second side top flap pivotally connected to the second side panel, and the rear top flap pivotally connected to the rear panel; a first side bottom flap, a front bottom flap, and a rear bottom flap, the first side bottom flap pivotally connected to the first side panel, the front bottom flap pivotally connected to the front panel, and the rear bottom flap pivotally connected to the rear panel; and an inner portion including a plurality of pivotally connected walls; wherein the outer portion is foldable into a box and the inner portion is foldable into a sleeve, the box receiving the sleeve, the sleeve delimiting a plurality of chambers in the box and wherein the outer portion includes a plurality of openings corresponding to the plurality of chambers to allow a user to access the chambers.

Also provided herein is a method of distributing earplugs of a plurality of different types. The method generally includes forming a container having a plurality of openings in a front panel; forming an insertion sleeve; inserting the insertion sleeve at an interior of the container delimiting a plurality of distinct chambers in the interior; aligning each chamber with one of the respective openings; placing the earplugs in the chambers, the chambers each receiving a distinct type of the earplugs; and sealing the container and providing access through the openings to the earplugs.

The above-discussed and other features and advantages of the present invention will be appreciated and understood by those skilled in the art from the following detailed description and drawings.

BRIEF DESCRIPTION OF THE DRAWINGS

Referring to the FIGURES wherein like elements are numbered alike in the several FIGURES.

DESCRIPTION OF THE PREFERRED EMBODIMENT

Figure 1:
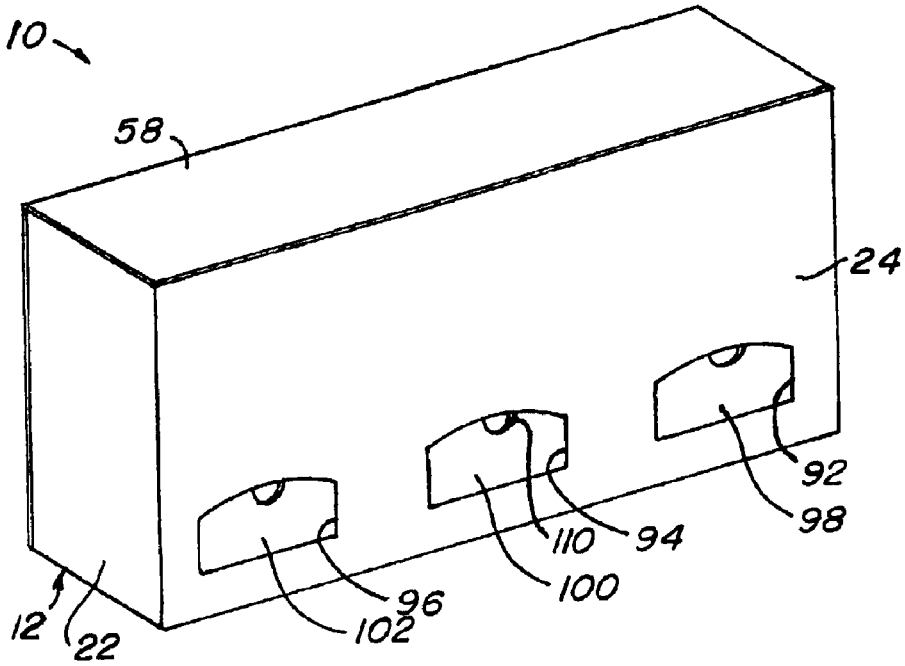
FIG. 1 is a perspective view of an earplug distribution assembly.
Figure 1A:
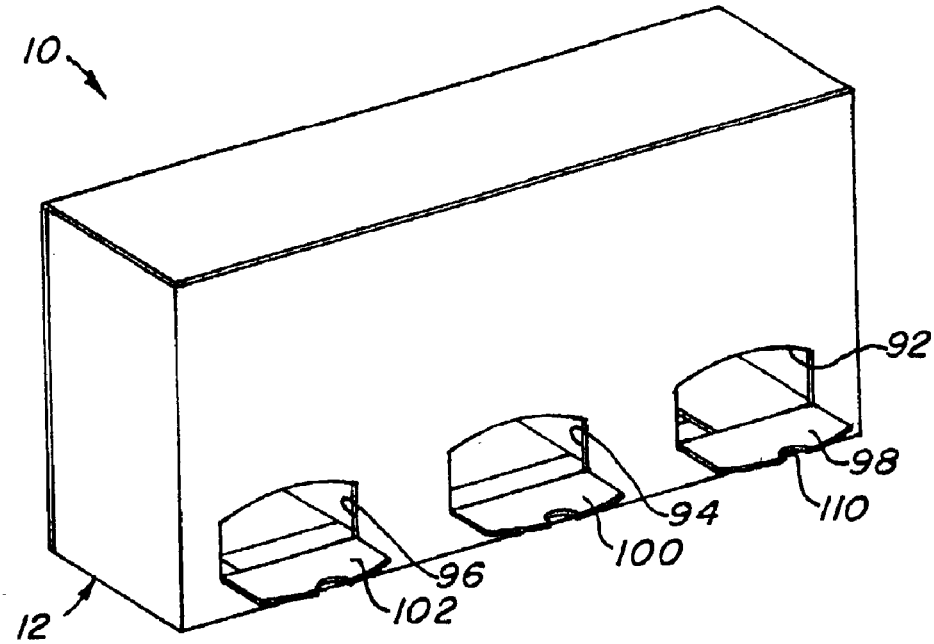
FIG. 1A is a perspective view of the earplug distribution assembly showing opening flaps disposed in an opening position.

An earplug distribution assembly 10 is shown in one embodiment in FIGS. 1–4.

The earplug distribution assembly 10 includes an outer portion 12 and an inner portion 14. In use, the inner portion 14 is disposed at an interior of the outer portion 12 and delimits a first chamber 142, a second chamber 144, and a third chamber 146.

The outer portion 12 includes a first side panel 22, a front panel 24, a second side panel 26, and a rear panel 28. The first side panel 22 is pivotally connected to the front panel 24 at a first vertical hinge portion 30; the front panel 24 is pivotally connected to the second side panel 26 at a second vertical hinge portion 32; and the second side panel 26 is pivotally connected to the rear panel 28 at a third vertical hinge portion 34. A side flap 36 is pivotally connected to the first side panel 22, opposite the front panel 24, at a fourth vertical hinge portion 38.

The first side panel 22, the front panel 24, the second side panel 26, the rear panel 28, and the side flap 36 are rotatably displaceable about the first vertical hinge portion 30, the second vertical hinge portion 32, the third vertical hinge portion 34, and the fourth vertical hinge portion 36, respectively.

The outer portion 12 of the earplug distribution assembly 10 further includes a first side top flap 40 pivotally connected to the first side panel 22 at a first horizontal hinge portion 42. A first side bottom flap 44 is pivotally connected to the first side panel 22, opposite the first side top flap 40, at a second horizontal hinge portion 45. A front bottom flap 46 is pivotally connected to the front panel 24 at a third horizontal hinge portion 48. The outer portion 12 further includes second side top and bottom flaps 50 and 52 pivotally connected to the second side panel 26 at fourth and fifth horizontal hinge portions 54 and 56, respectively. Rear top and bottom flaps 58 and 61 are pivotally connected to the rear panel 28 at sixth and seventh horizontal hinge portions 62 and 64, respectively. The rear top flap 58 includes a lip flap 60 pivotally connected thereto, opposite the sixth horizontal hinge 62.

The first side top flap 40, the first side bottom flap 44, the front bottom flap 46, the second side top flap 50, the second side bottom flap 52, the rear top flap 58, and the rear bottom flap 61 are rotatably displaceable about the first, second, third, fourth, fifth, sixth, and seventh horizontal hinge portions, respectively.

The following are rectangular planar members: the first side panel 22, the front panel 24, the second side panel 26, the rear panel 28, the first side bottom flap 44, the front bottom flap 46, the second side bottom flap 52, the rear top flap 58, and the rear bottom flap 61. The first side panel 22, the front panel 24, the second side panel 26, and the rear panel 28 have a length, L1. The first side top flap 40, the second side top flap 50 and the combination of the rear top flap 58 and the lip flap 60 have a length, L2. The first side bottom flap 44, the front bottom flap 46, the second side bottom flap 52, and the rear bottom flap 61 have a length, L3. The first side panel 22, the first side bottom flap 44, the second side panel 26, and the second side bottom panel 52 have a width, W1. The front panel 24, the front bottom flap 46, the rear panel 28, the rear top flap 58, and the rear bottom flap 61 have a width, W2. The lengths L1, L2, and L3 are measured in a direction perpendicular to a direction in which the widths W1 and W2 are measured.

The first side top flap 40 and the second side top flap 50 are planar parallelogram elements each having two parallel sides 66 and one side 68 perpendicular thereto. Each of the first and second top flaps 40 and 50 also include a fourth side 70 having a portion 72 parallel to the side 68 and a portion 74 angled toward the side 68 such that the portion 74 forms an angle of greater than ninety degrees with the side 66. The second side top flap 50 includes a notch 76 at an intersection of the sides 66 and 68.

The side flap 36 is a thin elongated planar parallelogram element having a side 78 which extends the length of the first side panel 22 at the fourth vertical hinge portion 38. A side 80 is disposed opposite and parallel to the side 78 and has a shorter length than the side 78. Two angled sides 82 extend from the side 78 to the side 80, thus completing the side flap 36.

The lip flap 60 has a width slightly less than W2 and includes a first side 84 fixed to the rear top flap 58 at an eighth hinge portion 86. Opposite sides 88 extend perpendicularly from the side 84 and then curve toward each other to meet the side 90 which extends parallel to side 84. The eighth horizontal hinge portion 86 is parallel to the sixth horizontal hinge portion 62. The lip flap 60 is rotatably displaceable about the eighth hinge portion 86.

The first, second, third, and fourth vertical hinge portions 30, 32, 34, and 38 are disposed parallel to one another. The first, second, third, fourth, fifth, sixth, seventh, and eighth horizontal hinge portions 42, 45, 48, 54, 56, 62, 64, and 86 are disposed parallel to one another and substantially perpendicular to the first, second, third, and fourth vertical hinge portions 30, 32, 34, and 38.

The front panel 24 includes adjacent first, second, and third openings 92, 94, and 96 which provide a passageway to the interior of the earplug distribution assembly 10. The front panel 24 further includes first, second, and third access flaps 98, 100, and 102 corresponding to first, second, and third openings 92, 94, and 96, respectively. The access flaps extend across the respective openings and include a lower side 104. The first, second, and third access flaps 98, 100, and 102 are substantially rectilinear planar elements but include a rounded side 108 opposite the lower side 104. A finger notch 110 is formed in the rounded side 108. The lower side 104 is pivotally connected to the front panel 24 at an opening hinge portion 106. The remaining sides of the opening flaps are attached to the front panel 24 by a perforated portion so all sides but the lower side 104 may be separated from the front panel 24, thus allowing the opening flaps be rotatably displaceable about the opening hinge portions 106.

Figure 2:
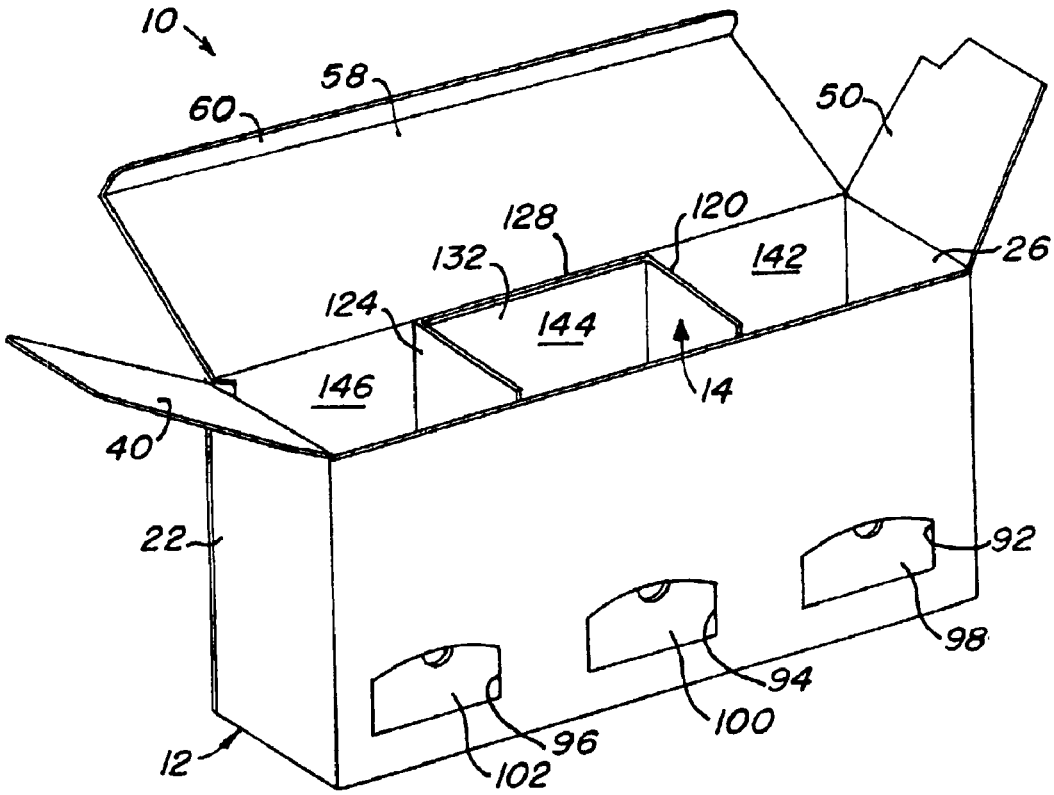
FIG. 2 is a perspective view of the earplug distribution assembly with top flaps in an opened condition.
Figure 3:
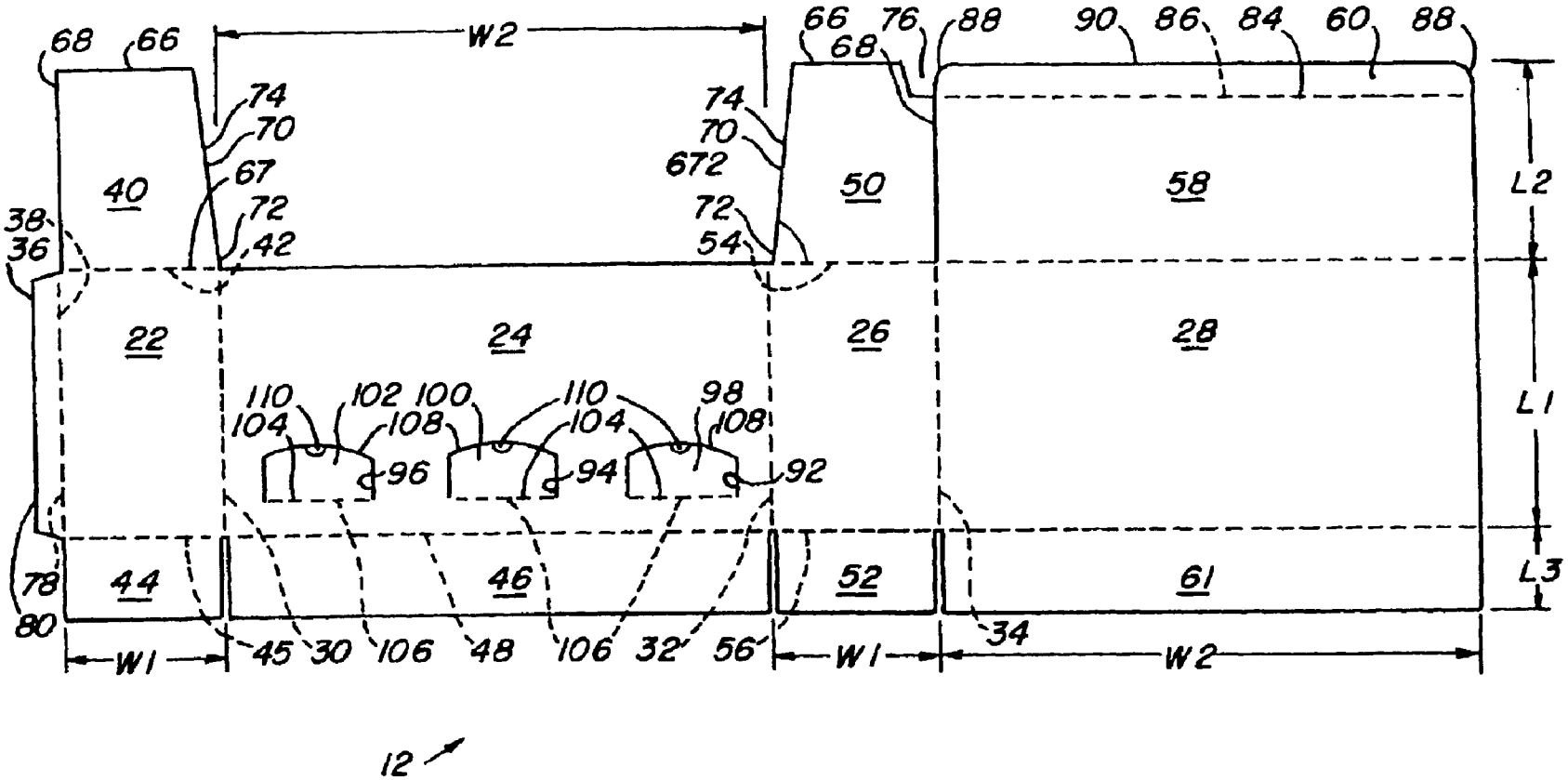
FIG. 3 is a plan view of an outer portion of the earplug distribution assembly.
Figure 4:
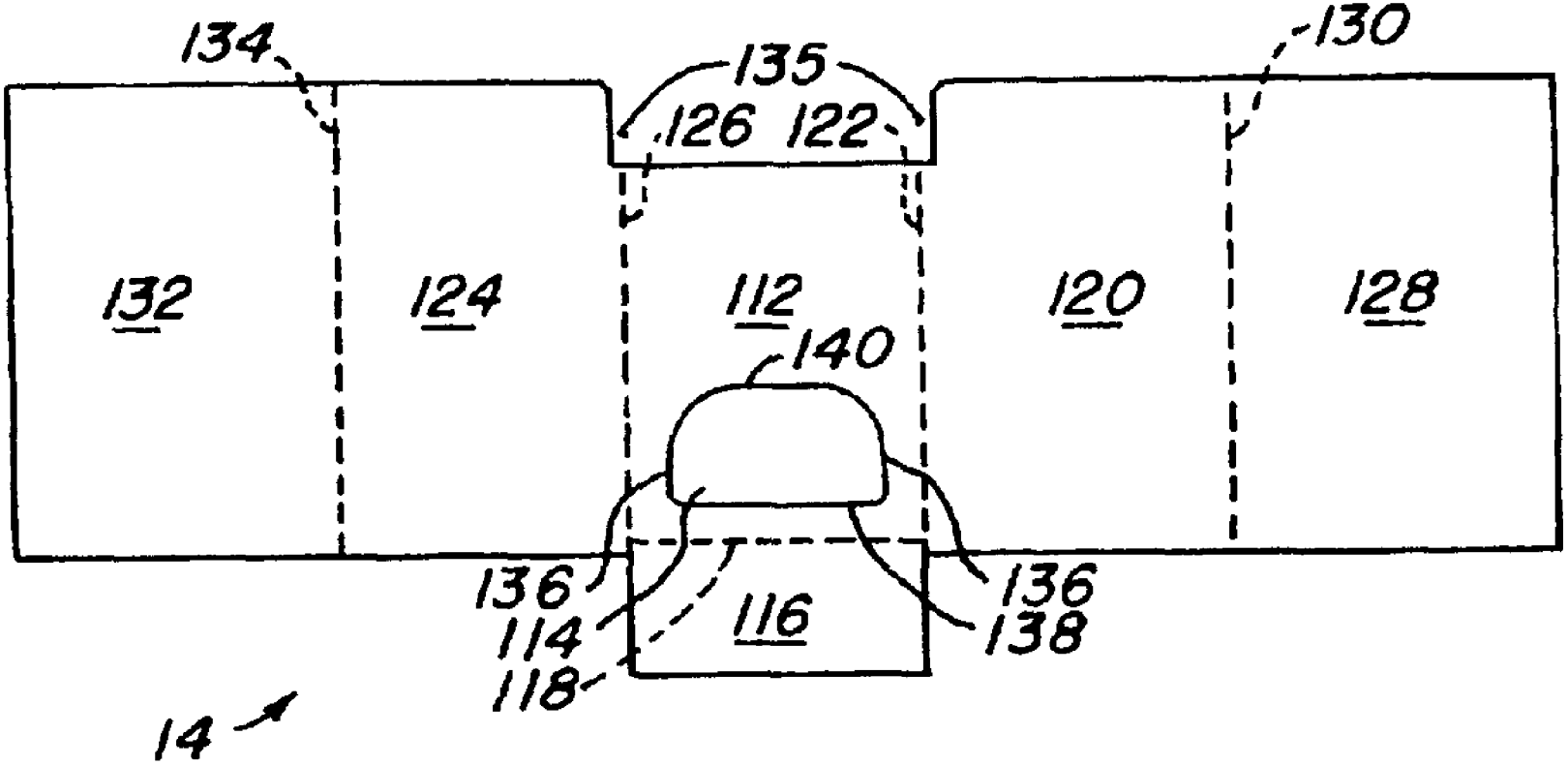
FIG. 4 is a plan view of an inner portion of the earplug distribution assembly.

The outer portion 12 is assembled by rotating the first side panel 22 and the side flap 36 in a first circular direction about the first vertical hinge portion 30 and the fourth vertical hinge portion 38, respectively, and rotating the second side panel 26 and the rear panel 28 in a second circular direction about the second vertical hinge portion 32 and the third vertical hinge portion 34, respectively, where the first and second circular directions are opposite one another, e.g., clockwise and counterclockwise, respectively, such that the side 80 of the side flap 36 meets the rear panel 28 at a side opposite the third vertical hinge portion 34. An outer portion of the side flap 36 is fixed at inside of the rear panel 28. Then, the first side bottom flap 44 and the second side bottom flap 52 are rotated about the second horizontal hinge portion 45 and the fifth horizontal hinge portion 56, respectively, toward the interior of the outer portion 12. Similarly, the front bottom flap 46 and the rear bottom flap 61 are rotated toward the interior of the outer portion 12 so as to be positioned over the first and second side bottom flaps 44 and 52. The front and rear bottom flaps 46 and 61 are then fixed to each other with, for example, packaging tape or an adhesive. Now, the outer portion appears as shown in FIG. 2.

The top of the outer portion 12 is closable as shown in FIG. 1 by rotating the first and second side top flaps 40 and 50 toward the interior of the outer portion 12 into a position perpendicular to the first and second side panels 22 and 26, respectively. Then, the rear top flap 58 is also rotated toward the interior of the outer portion 12 into a position perpendicular to the rear panel 28. Finally, the lip flap 60 is pivoted toward the interior of the outer portion 12 and tucked therein adjacent an inside of the front panel 24 whereat the lip flap is optionally fixed to the front panel 24 with, for example, an adhesive.

The inner portion 14 includes a front wall 112 having a portal 114 formed therein and a bottom wall 116 attached thereto proximate a lower side at a ninth horizontal hinge portion 118. A first side wall 120 is pivotally connected to the front wall 112 at a fifth vertical hinge portion 122. A second side wall 124 is pivotally connected to the front wall 112 at a sixth vertical hinge portion 126. The inner portion 14 further includes a first rear wall 128 pivotally connected to the first side wall 120, opposite the front wall 112, at a seventh vertical hinge portion 130. Finally, the inner portion 14 includes a second rear wall 132 pivotally connected to the second side wall 124, opposite the front wall 112, at an eighth vertical hinge portion 134.

The front wall 112, the bottom wall 116, the first rear wall 128, and the second rear wall 132 are planar rectangular elements. The first and second rear walls 128 and 132 have identical dimensions. The front wall 112 and the bottom wall 116 have widths identical to a width of the first and second rear walls 128 and 132 but have lengths less than that of the first and second rear walls 128 and 132.

The first and second side walls 120 and 124 are substantially rectangular planar elements but include a notched corner 135 at one end of the fifth and sixth vertical hinge portions 122 and 126, opposite the bottom wall 116. The first and second side walls 120 and 124 include a length identical to that of the first and second rear walls 128 and 132 but have a width less than that of the first and second rear walls 128 and 132 and substantially similar to the width W1 of the first and second side panels 22 and 26 of the outer portion 12. A width of the first and second side walls 120 and 124 at the notched corner 135 is less than a width of the first and second side walls 120 and 124 elsewhere.

The portal 114 is an opening in the front wall 112 positioned therein so as to align with the second opening 94 of the front panel 24 when the outer and inner portions 12 and 14 are assembled to form the earplug distribution assembly 10 (see below). The portal 114 includes two parallel sides 136, one side 138 perpendicular to the parallel sides, and a rounded side 140 joining the two parallel sides.

The inner portion is assembled by rotating the first rear wall 128 and the first side wall 120 in a first circular direction about the seventh vertical hinge portion 130 and the fifth vertical hinge portion 122, respectively, and rotating the second rear wall 132 and the second side wall 124 in a second circular direction about the eighth vertical hinge portion 134 and the sixth vertical hinge portion 126, respectively, where the first and second circular directions are opposite one another, e.g., clockwise and counterclockwise, respectively, such that the first rear wall 128 overlaps the second rear wall 132, an inside surface of the first rear wall 128 being flush against an outside surface of the second rear wall 132 as can be seen in FIG. 2. The bottom wall 116 is then rotated about the ninth horizontal hinge 118 in a direction toward the first and second rear walls 128 and 132. The bottom wall 116 may then be optionally fixed to a lower portion of the first and second side walls 120 and 124.

The earplug distribution assembly 10 is assembled by first forming the outer portion 12 and the inner portion 14, as described herein. Then, the inner portion 14 is placed at the interior of the outer portion 12, as shown in FIG. 2, such that: the first and second side walls 120 and 124 are positioned parallel to the first and second side panels 22 and 26; the front wall 112 and the first and second rear walls 128 and 132 are disposed parallel to the front and rear panels 24 and 28; and the bottom wall 116 is disposed adjacent and parallel to the front and rear bottom flaps 46 and 61. The inner portion 14 is received in the interior of the inner portion 12 and retained therein by a friction fit. Alternatively, the inner portion 14 may be fixed at the inside of the outer portion 12 by, for example, applying an adhesive between the first and second rear walls 128 and 132 and between the first rear wall 128 and an inside surface of the rear panel 28. Of course, the invention contemplates other means of mounting and/or fixing the inner portion 14 at the inside of the outer portion 12.

The inner portion 14, when assembled and properly inserted in the outer portion 12, delimits distinct first, second, and third distribution chambers 142, 144, and 146, as shown particularly in FIG. 2. The first, second, and third distribution chambers 142, 144, and 146 are designed to contain individual earplugs or packaged pairs of earplugs. A different type of earplug, e.g., foam roll down type earplug, push-in stemmed earplugs, etc., may be stored in each of the first, second, and third distribution chambers 142, 144, and 146. The front panel 24 of the outer portion 12 may include labeling or notation to indicate the type and proper use of the earplugs contained in each of the first, second, and third distribution chambers 142, 144, and 146. The construction of the inner portion 14 and its disposition inside the outer portion ensure that earplugs stored in the first, second, and third distribution chambers 142, 144, and 146 do not intermingle.

A user accesses the first, second, and third distribution chambers 142, 144, and 146, and the earplugs therein, through the first, second, and third openings 92, 94, and 96, respectively. When the earplugs are ready to be accessed, the user separates the particular opening flap 98, 100, or 102 from the front panel 24 and rotates the opening about the respective opening hinge portion 106 in a direction toward the exterior of the outer portion 12. The user then inserts a hand through the opening (and in the case of the second opening 94, through the portal 114) into the respective first, second, or third distribution chamber 142, 144, and 146 to access the stored earplugs. The finger notch 110 aids the user in separating the opening flaps 98, 100, and 102 by providing an area to insert a finger, grip the opening flap and pull so as to rotate the flap to an open position as described.

While the earplug distribution assembly 10 is describe herein to include three distribution chambers 142, 144, and 146 accessible through three openings 92, 94, and 96, respectively, the invention is in no way limited to this configuration. For example, the earplug distribution assembly 10 may include two inner portions 14 thus creating up to five distribution chambers for which the front panel may include five openings to facilitate access to the various chambers. That is, the invention contemplates distributing any plurality of earplug types via a corresponding plurality of distribution chambers and is not limited simply to the first, second, and third distribution chambers 142, 144, and 146 described herein.

The earplug distribution assembly 10 may be made of any material suitable for shipping, storing and distributing earplugs as described herein. For example, the earplug distribution assembly 10 may be constructed of corrugated paper board, the various vertical and horizontal hinge portions being fold lines made in the corrugated paper board during manufacturing thereof. Alternatively, the earplug assembly 10 may be constructed of plastic, rubber, ceramic, metal, etc. The hinge portions may be any portion or element suitable for allowing the rotational movement described herein and may include a living hinge scored into the material of the assembly 10, a plastic or rubber hinge bonded to the various panels, walls, and flaps, a metallic hinge, etc.

Prior to shipping the earplug distribution assembly 10 to a manufacturing or industrial facility, the first, second, and third distribution chambers 142, 144, and 146 may each be filled with a distinct type of earplug so as to cater the earplug distribution assembly 10 to the particular facility's conditions or needs, e.g., noise level conditions, metal detectability, hygiene concerns, etc. For instance, the earplug distribution assembly 10 may include three different types of: high performance earplugs each having NRRs of 33 or above; corded high performance earplugs; foam roll-down type earplugs; corded foam plugs; push-in stemmed earplugs; or metal detectable earplugs. Alternatively, the first, second, and third distribution chambers 142, 144, and 146 of earplug distribution assembly 10 may be stocked with a variety of the above-mentioned or other earplugs.

While the earplug distribution assembly 10 is described herein with reference to distribution of earplugs, the invention contemplates distribution of any small product which is easily stored in the first, second, and third distribution chambers 142, 144, and 146 and accessible therefrom.

The earplug distribution assembly 10 may include a wall mount or other means of fixing the assembly 10 on a vertical wall to facilitate distribution of the earplug to users. Alternatively, the earplug distribution assembly 10 may be placed on or fixed on a table for easy access.

The earplug distribution assembly of the present invention provides an earplug dispenser which is easy to manufacture and assemble and which is capable of conveniently distributing a plurality of earplug types in an efficient, effective, and consistent manner. The earplug distribution assembly allows for distribution of distinct earplug types in a low cost manner which does not consume valuable facility area nor result in undesired sanitary conditions or waste associated with known distribution means. Further, the earplug distribution assembly provides a method for an earplug manufacturer or shipper to provide a manufacturing or industrial facility with an easily accessible selection of a variety of earplug types particularly catered to the facility's needs, preferences, and requirements.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An earplug distribution assembly, comprising:

an outer portion including four outer side panels, a top panel, and a bottom panel connected to form a box;

an inner portion disposed at an interior of the box, the inner and outer portions delimiting a plurality of chambers in the interior of the box; and earplugs stored in the chambers;

wherein one of the outer side panels includes openings corresponding to each of the plurality of chambers allowing a user to access the earplugs in the chambers; and wherein the one of the outer side panels further comprises a flag disposed across each of the opening, the flan being pivotable relative to the outer side panel in which the opening are formed, and the flap acting as a door to regulate access of the earplugs in the chamber.

2. The earplug distribution assembly of claim 1, wherein the inner portion includes four inner side walls connected to form a rectilinear sleeve.

3. The earplug distribution assembly of claim 2, wherein one of the four inner side walls includes a portal formed therein which is aligned with one of the openings to allow access to the chambers delimited by the rectilinear sleeve.

4. The earplug distribution assembly of claim 2, wherein the inner portion further includes a bottom wall disposed so as to close a portion of an open end of the rectilinear sleeve.

5. The earplug distribution assembly of claim 1, wherein the earplugs comprise a plurality of types of earplugs.

6. The earplug distribution assembly of claim 1, wherein each of the plurality of chambers includes a distinct type of earplug disposed therein.

7. The earplug distribution assembly of claim 1, wherein the plurality of chambers comprises a first chamber having a first type of the earplugs disposed therein and a second chamber having a second type of the earplugs disposed therein.

8. The earplug assembly of claim 7, wherein the first type of earplugs comprises roll-down type earplugs and the second type of earplugs comprises stemmed push-in earplugs.

9. A corrugated paper board product distribution assembly blank, comprising:

an outer portion including a first side panel, a second side panel, a front panel, and a rear panel, the first side panel being pivotally connected to the front panel, the front panel being pivotally connected to the second side panel, and the second side panel being pivotally connected to the rear panel;

a first side top flap, a second side top flap, and a rear top flap, the first side top flap pivotally connected to the first side panel, the second side top flap pivotally connected to the second side panel, and the rear top flap pivotally connected to the rear panel;

a first side bottom flap, a second side bottom flap, a front bottom flap, and a rear bottom flap, the first side bottom flap pivotally connected to the first side panel, the second side bottom flap pivotally connected to the second side panel, the front bottom flap pivotally connected to the front panel, and the rear bottom flap pivotally connected to the rear panel; and an inner portion including a plurality of pivotally connected walls;

wherein the plurality of pivotally connected walls of the inner portion further comprise a front wall connected to first and second side walls disposed on opposite sides of the front wall, a first rear wall connected to the first side wall opposite the front wall, and a second rear wall connected to the second side wall opposite the front wall; and wherein the outer portion is foldable into a box and the inner portion is foldable into a sleeve, the box receiving the sleeve, the sleeve delimiting a plurality of chambers in the box and wherein the outer portion includes a plurality of openings corresponding to the plurality of chambers to allow a user to access the chambers.

10. The corrugated paper board product distribution assembly blank of claim 9, wherein the front wall includes a portal formed therein which is alignable with one of the openings to allow access to the corresponding chamber.

11. The corrugated paper board product distribution assembly blank of claim 9, wherein the plurality of pivotally connected walls of the inner portion further comprise a bottom wall connected to the front wall.

12. The corrugated paper board product distribution assembly blank of claim 7, further comprising a flap disposed across each of the openings, the flap being pivotable relative to the front panel.

13. The corrugated paper board product distribution assembly blank of claim 9, wherein said pivotal connections are fold lines formed in the corrugated paper board.

14. An earplug distribution assembly, comprising:

an outer portion including four outer side panels, a top panel, and a bottom panel connected to form a box;

an inner portion disposed at an interior of the box, the inner and outer portions delimiting a plurality of chambers in the interior of the box; and earplugs stored in the chambers;

wherein one of the outer side panels includes openings corresponding to each of the plurality of chambers allowing a user to access the earplugs in the chambers; and wherein the inner portion includes four inner side walls connected to form a rectilinear sleeve.

* * * * *